US007686580B2

(12) United States Patent
Cunha et al.

(10) Patent No.: US 7,686,580 B2
(45) Date of Patent: Mar. 30, 2010

(54) TURBINE ELEMENT

(75) Inventors: Frank J. Cunha, Avon, CT (US); Matthew T. Dahmer, Auburn, MA (US)

(73) Assignee: United Technologies Corporation, Hartford, CT (US)

( * ) Notice: Subject to any disclaimer, the term of this patent is extended or adjusted under 35 U.S.C. 154(b) by 1156 days.

(21) Appl. No.: 11/226,120

(22) Filed: Sep. 14, 2005

(65) Prior Publication Data

US 2007/0237639 A1 Oct. 11, 2007

Related U.S. Application Data

(63) Continuation of application No. 10/409,521, filed on Apr. 8, 2003, now Pat. No. 7,014,424.

(51) Int. Cl.
*B63H 1/14* (2006.01)

(52) U.S. Cl. ..... 416/97 R; 415/115; 415/116

(58) Field of Classification Search ..... 415/115–116; 416/96 R, 97 R, 97 A
See application file for complete search history.

(56) References Cited

U.S. PATENT DOCUMENTS

| | | | | |
|---|---|---|---|---|
| 3,957,104 | A | 5/1976 | Terpay | |
| 4,278,400 | A | 7/1981 | Yamarik et al. | |
| 4,596,281 | A | 6/1986 | Bishop | |
| 4,752,186 | A | 6/1988 | Liang | |
| 4,775,296 | A | 10/1988 | Schwarzmann et al. | |
| 5,243,759 | A | 9/1993 | Brown et al. | |
| 5,288,207 | A | 2/1994 | Linask | |
| 5,337,805 | A | 8/1994 | Green et al. | |
| 5,511,309 | A | 4/1996 | Beabout | |
| 5,975,851 | A | 11/1999 | Liang | |
| 6,234,754 | B1 | 5/2001 | Zelesky et al. | |
| 6,254,334 | B1 | 7/2001 | LaFleur | |
| 6,340,047 | B1 | 1/2002 | Frey | |
| 6,481,966 | B2 | 11/2002 | Beeck et al. | |
| 6,514,042 | B2 | 2/2003 | Kvasnak et al. | |
| 6,637,500 | B2 | 10/2003 | Shah et al. | |
| 7,014,424 | B2 * | 3/2006 | Cunha et al. | 416/97 R |

FOREIGN PATENT DOCUMENTS

| | | |
|---|---|---|
| GB | 1605341 A | 1/1992 |
| JP | 2-40001 | 2/1990 |

OTHER PUBLICATIONS

European Search Report for EP Patent Application No. 04252073.4.

* cited by examiner

*Primary Examiner*—Hoang M Nguyen
(74) *Attorney, Agent, or Firm*—Bachman & LaPointe, P.C.

(57) ABSTRACT

A turbine element airfoil has a cooling passageway network with a slot extending from a trailing passageway toward the trailing edge. A number of discrete posts span the slot between pressure and suction sidewall portions. A trailing array of the posts are spaced ahead of an outlet of the slot.

23 Claims, 6 Drawing Sheets

TURBINE ELEMENT

CROSS-REFERENCE TO RELATED APPLICATION

This is a continuation of U.S. patent application Ser. No. 10/409,521, filed Apr. 8, 2003, now U.S. Pat. No. 7,014,424 and entitled "Turbine Element."

U.S. GOVERNMENT RIGHTS

The government may have rights in this invention, pursuant to Contract Number F33615-02-C-2202, awarded by the United States Air Force, Wright Patterson Air Force Base.

BACKGROUND OF THE INVENTION

This invention relates to gas turbine engines, and more particularly to cooled turbine elements (e.g., blades and vanes).

Efficiency is limited by turbine element thermal performance. Air from the engine's compressor bypasses the combustor and cools the elements, allowing them to be exposed to temperatures well in excess of the melting point of the element's alloy substrate. The cooling bypass represents a loss and it is therefore desirable to use as little air as possible. Trailing edge cooling of the element's airfoil is particularly significant. Aerodynamically, it is desirable that the trailing edge portion be thin and have a low wedge angle to minimize shock losses.

In one common method of manufacture, the main passageways of a cooling network within the element airfoil are formed utilizing a sacrificial core during the element casting process. The airfoil surface may be provided with holes communicating with the network. Some or all of these holes may be drilled. These may include film holes on pressure and suction side surfaces and holes along or near the trailing edge.

BRIEF SUMMARY OF THE INVENTION

Accordingly, one aspect of the invention is a turbine element having a platform and an airfoil. The airfoil extends along a length from a first end of the platform to a second end. The airfoil has leading and trailing edges and pressure and suction sides. The airfoil has a cooling passageway network including a trailing passageway and a slot extending from the trailing passageway toward the trailing edge. The slot locally separates pressure and suction sidewall portions of the airfoil and has opposed first and second slot surfaces. A number of discrete posts span the slot between the pressure and suction sidewall portions.

In various implementations, the posts may have dimensions along the slot no greater than 0.10 inch. The second end may be a free tip. The posts may include a leading group of posts, a first metering row of posts trailing the leading group, a second metering row of posts trailing the first metering row, and at least one intervening group between the first and second metering rows. The first metering row may have a restriction factor greater than that of the leading group. The second metering row may have a restriction factor greater than that of the leading group. The intervening group may have a restriction factor less than the restriction factors of the first and second metering rows. The posts may include a trailing array of posts spaced ahead of an outlet of the slot. The blade may consist essentially of a nickel alloy. The exact trailing edge of the airfoil may fall along an outlet of the slot. The posts may be arranged with a leading group of a number of rows of essentially circular posts, a trailing row of essentially circular posts, and intervening rows of posts having sections elongate in the direction of their associated rows. The posts may have dimensions along the slot no greater than 0.10 inch.

Another aspect of the invention is a turbine element-forming core assembly including a ceramic element and a refractory metal sheet. The ceramic element has portions for at least partially defining associated legs of a conduit network within the turbine element. The refractory metal sheet is secured to the ceramic element positioned extending aft of a trailing one of the portions. The sheet has apertures extending between opposed first and second surfaces for forming associated posts between pressure and suction side portions of an airfoil of the turbine element.

In various implementations there may be at least one row of circular apertures and at least one row of apertures elongate substantially in the direction of their row. There may be plural such rows of elongate apertures. The elongate apertures may be substantially rectangular. The rows may be arcuate. The rows may be arranged with a first subgroup of rows having apertures having a characteristic with and a greater characteristic separation and a first metering row trailing the first subgroup having a characteristic with and a lesser characteristic separation. The assembly may be combined with a mold wherein pressure and suction side meeting locations of the mold and the sheet fall along essentially unapertured portions of the sheet.

Another aspect of the invention is directed to manufacturing a turbine blade. A ceramic core and apertured refractory metal sheet are assembled. A mold is formed around the core and sheet. The mold has surfaces defining a blade platform and an airfoil extending from a root at the platform to a tip. The assembled core and sheet have surfaces for forming a cooling passageway network through the airfoil. A molten alloy is introduced to the mold and is allowed to solidify to initially form the blade. The mold is removed. The assembled core and refractory metal sheet is destructively removed. A number of holes may then be drilled in the blade for further forming the cooling passageway network. Holes may be laser drilled in the sheet prior to assembling it with the core.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
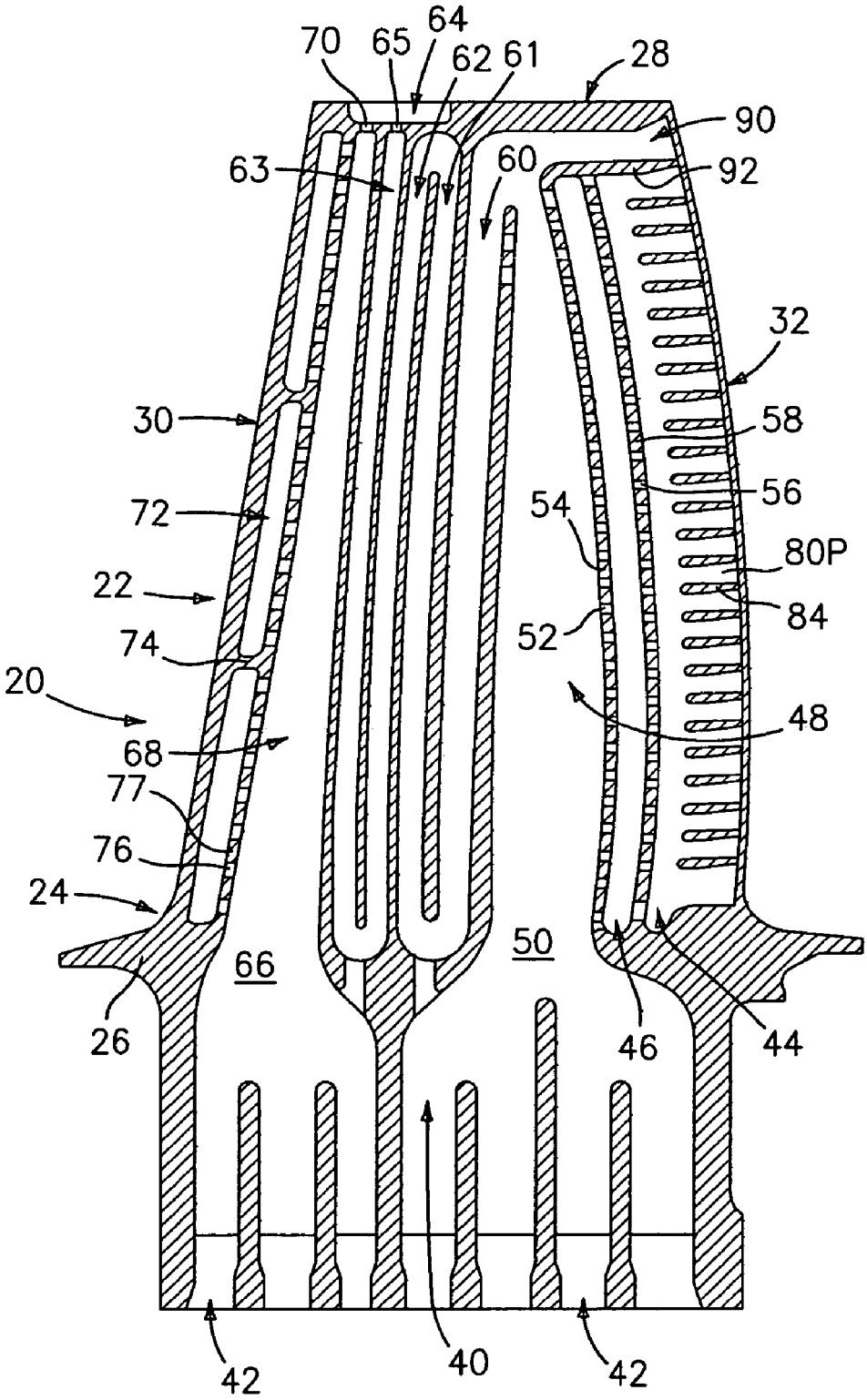
FIG. 1 (PRIOR ART)
FIG. 1 is a mean sectional view of a prior art blade.

FIG. 1 shows a prior turbine blade 20 having an airfoil 22 extending along a length from a proximal root 24 at an inboard platform 26 to a distal end 28 defining a blade tip. A number of such blades may be assembled side by side with their respective platforms forming an inboard ring bounding an inboard portion of a flow path. In an exemplary embodiment, the blade is unitarily formed of a metal alloy.

Figure 2:
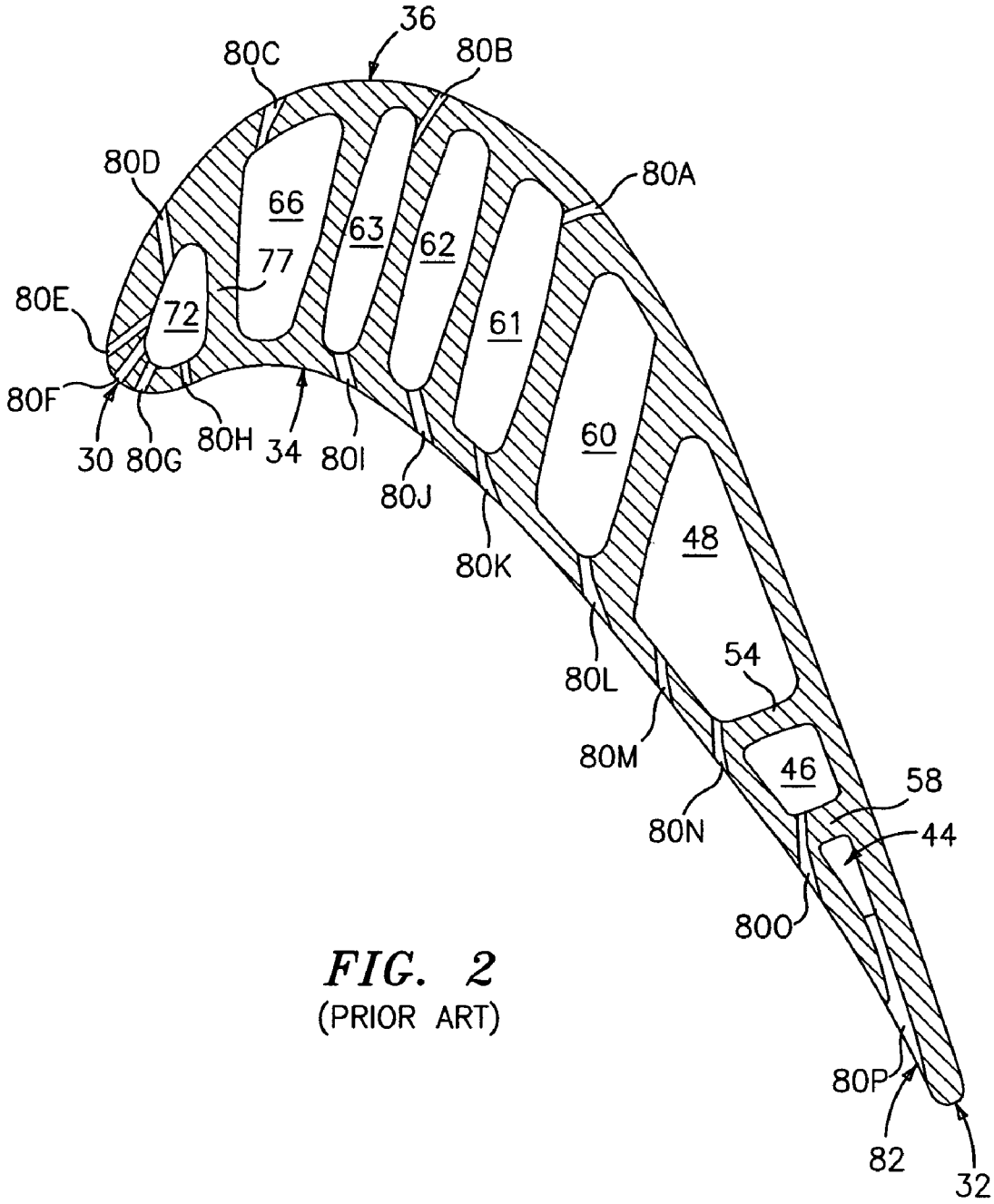
FIG. 2 (PRIOR ART)
FIG. 2 is a sectional view of an airfoil of the blade of FIG. 1.

The airfoil extends from a leading edge 30 to a trailing edge 32. The leading and trailing edges separate pressure and suction sides or surfaces 34 and 36 (FIG. 2). For cooling the airfoil, the airfoil is provided with a cooling passageway network 40 (FIG. 1) coupled to ports 42 in the platform. The exemplary passageway network includes a series of cavities extending generally lengthwise along the airfoil. An aftmost cavity is identified as a trailing edge cavity 44 extending generally parallel to the trailing edge 32. A penultimate cavity 46 is located ahead of the trailing edge cavity 32. In the illustrated embodiment, the cavities 44 and 46 are impingement cavities. The penultimate cavity 46 receives air from a trunk portion 48 of a supply cavity 50 through an array of apertures 52 in the wall 54 separating the two. The supply cavity 50 receives air from a trailing group of the ports in the platform. Likewise, the trailing edge cavity 44 receives air from the penultimate cavity 46 via apertures 56 in the wall 58 between the two. Downstream of the trunk 48, the supply cavity has a series of serpentine legs 60, 61, 62, and 63. The final leg 63 has a distal end vented to a tip or pocket 64 by an aperture 65. The exemplary blade further includes a forward supply cavity 66 receiving air from a leading group of the ports in the platform. The exemplary forward supply cavity 66 has only a trunk 68 extending from the platform toward the tip and having a distal end portion vented to the tip pocket 64 by an aperture 70. A leading edge cavity 72 has three isolated segments extending end-to-end inboard of the leading edge and separated from each other by walls 74. The leading edge cavity 72 receives air from the trunk 68 through an array of apertures 76 in a wall 77 separating the two.

The blade may further include holes 80A-80P (FIG. 2) extending from the passageway network 40 to the pressure and suction surfaces 34 and 36 for further cooling and insulating the surfaces from high external temperatures. Among these holes, an array of trailing edge holes 80P extend between a location proximate the trailing edge and an aft extremity of the trailing edge impingement cavity 44. The illustrated holes 80P have outlets 82 along the pressure side surface just slightly ahead of the trailing edge 32. The illustrated holes 80P are formed as slots separated by islands 84 (FIG. 1).

In the exemplary blade, air passes through the cavities 46 and 44 from the trunk 48 by impinging on the walls 54 and 58 in sequence. Thus, the cavities 46 and 44 are identified as impingement cavities. This air exits the cavity 44 via the slots 80P. Additional air is vented through a trailing edge tip slot 90 (FIG. 1) fed from the distal end of the trunk 48 and separated from the cavities 46 and 44 by a wall 92.

The blade may be manufactured by casting with a sacrificial core. In an exemplary process, the core comprises a ceramic piece or combination of pieces forming a positive of the cooling passageway network including the cavities, tip pocket, various connecting apertures and the holes 80P, but exclusive of the film holes 80A-80O. The core may be placed in a permanent mold having a basic shape of the blade and wax or other sacrificial material may be introduced to form a plug of the blade. The mold is removed and a ceramic coating applied to the exterior of the plug. The ceramic coating forms a sacrificial mold. Molten metal may be introduced to displace the wax. After cooling, the sacrificial mold and core may be removed (such as by chemical leaching). Further machining and finishing steps may include the drilling of the holes 80A-80O. A vane (e.g., having platforms at both ends of an airfoil) may be similarly formed.

Figure 3A:
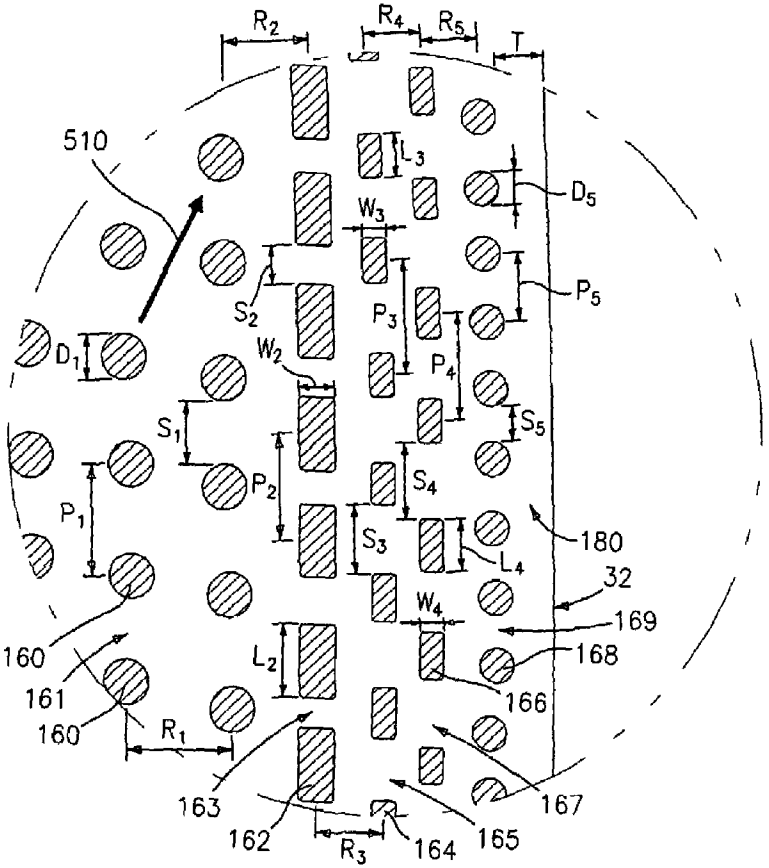
FIG. 3 is a mean sectional view of a blade according to principles of the invention.
Figure 3:
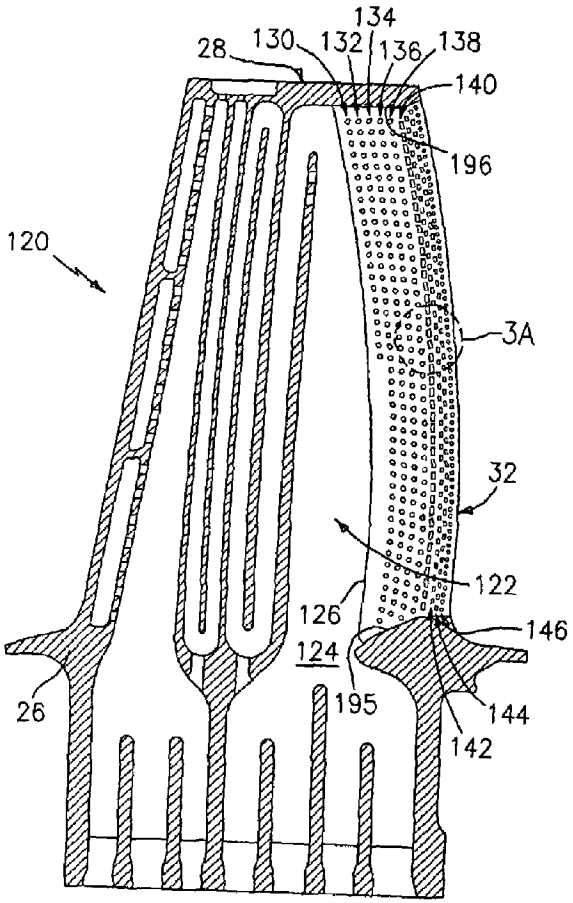

FIG. 3 shows a blade 120 according to the present invention. For purposes of illustration, the blade is shown as an exemplary relatively minimally reengineered modification of the blade 20 of FIG. 1. In this reengineering, external dimensions of the blade remain generally the same. Additionally, internal features of the blade ahead of the trunk 122 of the trailing supply cavity 124 are identical and are identified with identical numerals. Notwithstanding the foregoing, alternate reengineering might make further changes. Aft of a rear extremity 126 of the trunk 122, and without an intervening wall, are a number of rows 130, 132, 134, 136, 138, 140, 142, 144, and 146 of posts or pedestals. In the exemplary embodiment, the rows are slightly arcuate, corresponding to the arc of the trailing edge 32. In an exemplary embodiment, the leading row 130 extends only along a distal portion (e.g., about one half) of the length of the airfoil. The remaining rows extend largely all the way from the root to adjacent the tip. In the exemplary embodiment, the leading group of five rows 130-138 have pedestals 160 formed substantially as right circular cylinders and having interspersed gaps 161. The pedestals 160 have a first diameter D1 with a first on center spacing or pitch P1 and a first separation S1 wherein S1=P1−D1. D1 is thus a characteristic dimension of the pedestals 160 both along the centerline of the associated row and transverse thereto. A row pitch or centerline-to-centerline spacing R1 is slightly smaller than P1 and slightly larger than S1. The rows have their phases slightly staggered. The slight stagger is provided so that adjacent pedestals are approximately out of phase when viewed along an approximate overall flow direction 510 which reflects influence of centrifugal action.

The next row 140 has pedestals 162 formed substantially as rounded right rectangular cylinders. The pedestals 162 have a length L2 (measured parallel to the row), a width W2 (measured perpendicular to the row), a pitch P2, and a separation S2. In the exemplary embodiment, the pitch is substantially the same as P1 and the pedestals 162 are exactly out of phase with the pedestals 160 of the last row 138 in the leading group. This places the leading group last row pedestals directly in front of gaps 163 between the pedestals 162. A row pitch R2 between the row 140 and the row 138 is slightly smaller than R1. The next row 142 has pedestals 164 also formed substantially as rounded right rectangular cylinders. The pedestals of this row have length, width, pitch, and separation L3, W3, P3, and S3. In the exemplary embodiment, L3, and W3 are both substantially smaller than L2 and W2. The pitch P3, however, is substantially the same as P1 and the stagger also completely out of phase so that the pedestals 164 are directly behind associated gaps 163 and gaps 165 between the pedestals 164 are directly behind associated pedestals 162. A row pitch R3 between the row 142 and the row 140 thereahead is somewhat smaller than R2 and R1. The next row 144 has pedestals 166 also formed substantially as rounded right rectangular cylinders. The pedestals 166 have length, width, pitch, and spacing L4, W4, P4, and S4. In the exemplary embodiment, these are substantially the same as corresponding dimensions of the row 142 thereahead, but completely out of phase so that each pedestal 166 is immediately behind a gap 165 and each gap 167 is immediately behind a pedestal 164. A row pitch R4 between the row 144 and the row 142 thereahead is, like R3, substantially smaller than R2 and R1. In the exemplary embodiment, the trailing row 146 has pedestals 168 formed substantially as right circular cylinders of diameter D5, pitch P5, and spacing S5 of gaps 169 therebetween. In the exemplary embodiment, D5 is smaller than D1 and the rectangular pedestal lengths. Additionally, the pitch P5 is smaller than pitches of the other rows and separation S5 is smaller than the separations of the rows other than the row 140. A row pitch R5 between the row 146 and the row 144 thereahead is, like R3 and R4, substantially smaller than R1 and R2. In the exemplary embodiment, the centerline of the row 146 is sufficiently forward of the trailing edge 32 that there is a gap 180 between the trailing extremity of each pedestal 168 and the trailing edge 32. The exemplary gap has a thickness T approximately 100% to 200% of the diameter D5.

Figure 4:
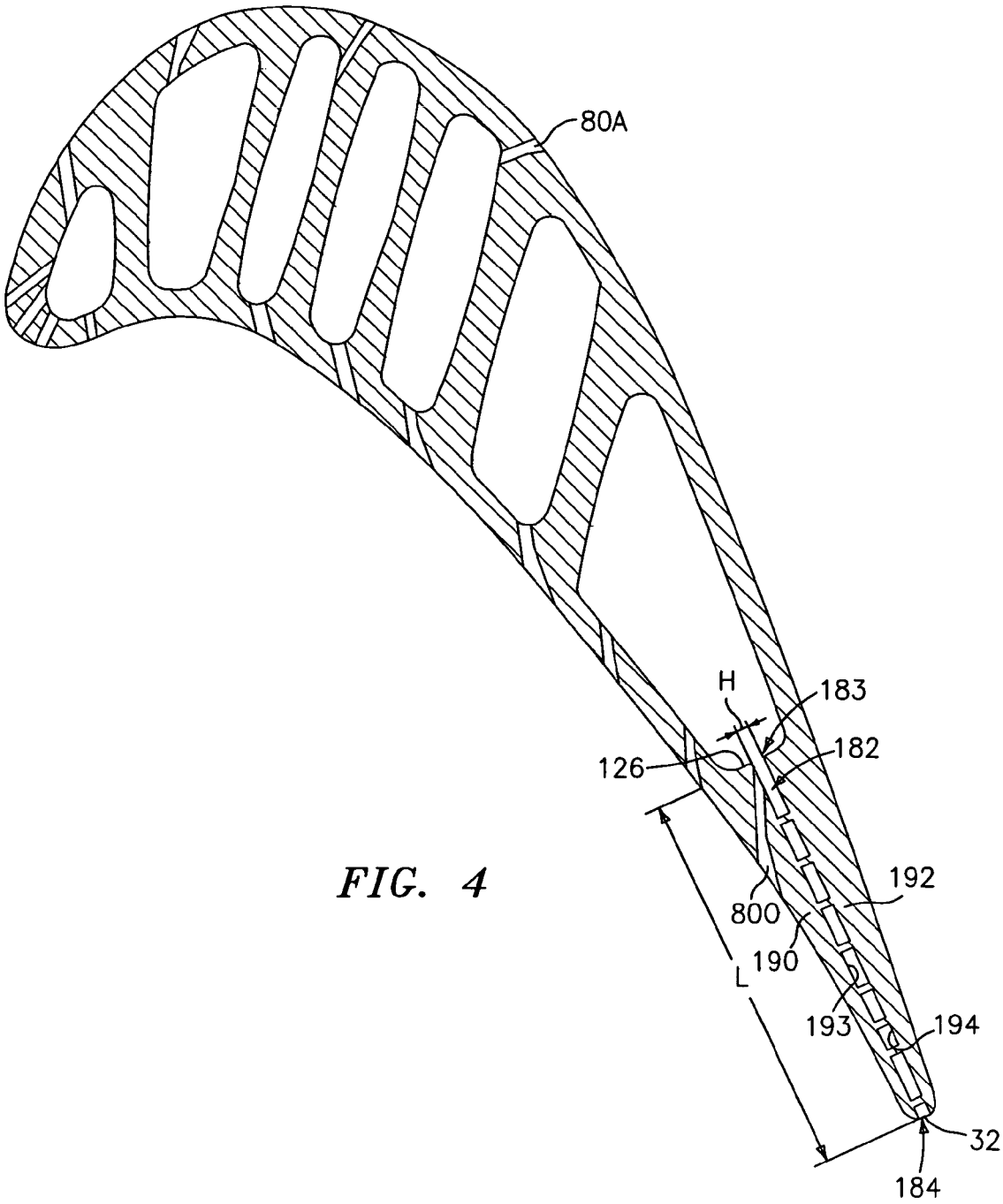
FIG. 4 is a sectional view of an airfoil of the blade of FIG. 1.

FIG. 4 shows the blade in a section taken to cut through pedestals of each row 132-146 for purposes of illustration. These pedestals are shown as formed within a slot 182 extending from an inlet 183 at the rear extremity 126 of trunk 122 to an outlet 184 at the trailing edge 32. The slot has a height H and an inlet-to-outlet length L. The slot locally separates wall portions 190 and 192 along the pressure and suction sides of the airfoil, respectively, having opposed facing parallel interior inboard surfaces 193 and 194. The slot extends from an inboard end 195 (FIG. 3) at the platform 26 to an outboard end 196 adjacent the tip 28.

Figure 5A:
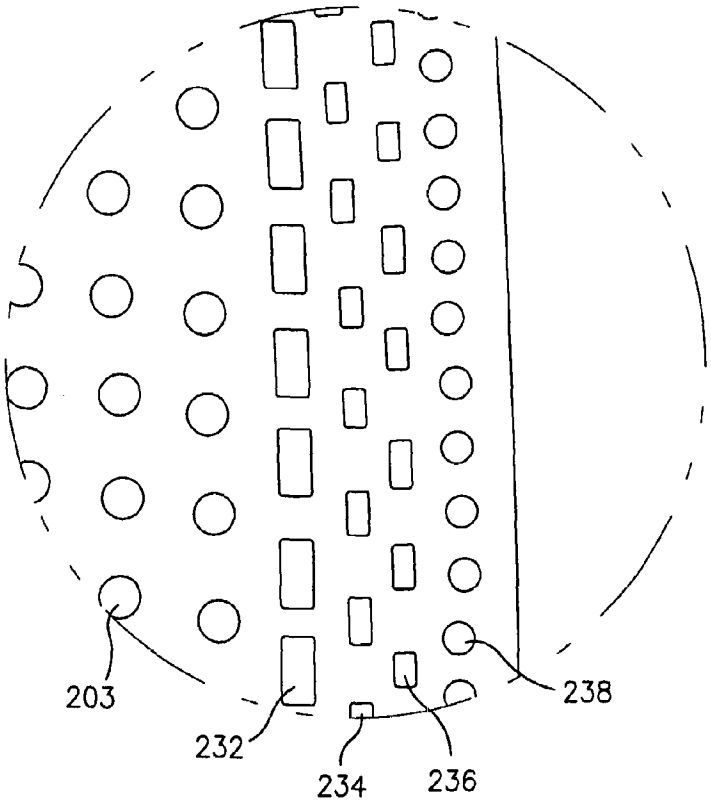
FIG. 5 is a top (suction side) view of an insert for forming the blade of FIG. 3.
Figure 5:
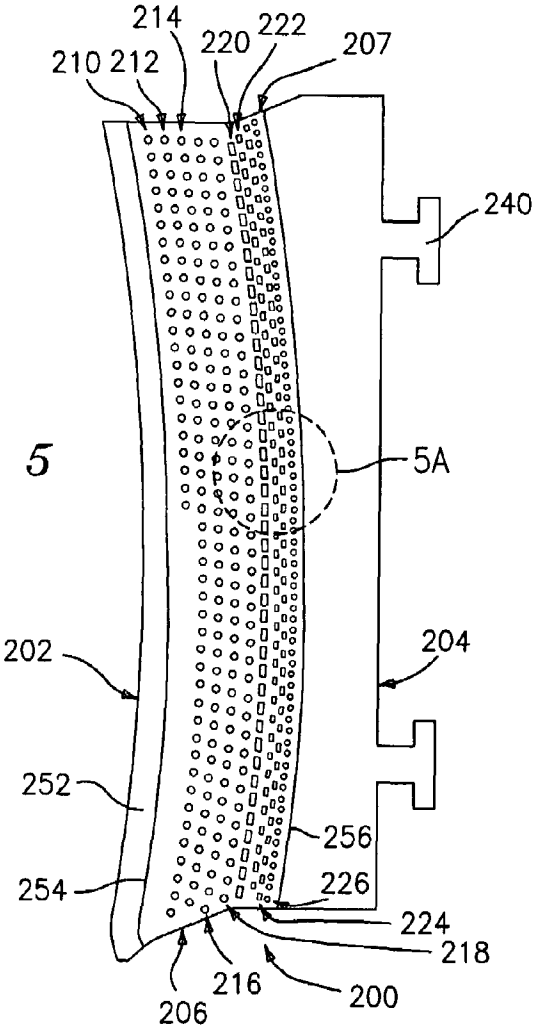
Figure 6:
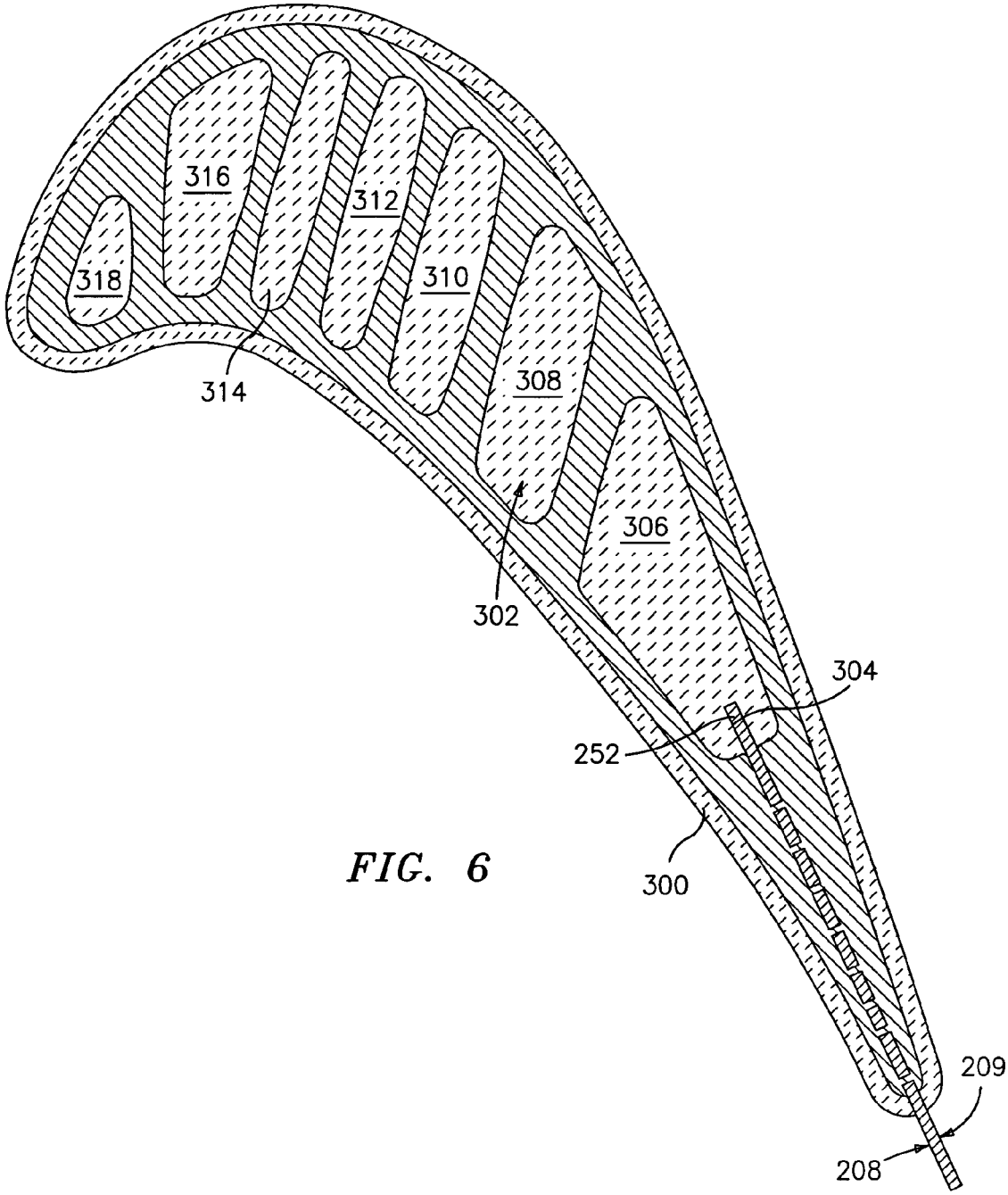
FIG. 6 is a sectional view of the blade of FIG. 3 during manufacture.

According to a preferred method of manufacture, the pedestals are formed by casting the blade over a thin sacrificial element assembled to a ceramic core. An exemplary sacrificial element is a metallic member (insert) partially inserted into a mating feature of the core. The insert may initially be formed from a refractory metal (e.g., molybdenum) sheet and then assembled to the ceramic core. FIG. 5 shows an insert 200 formed by machining a precursor sheet (e.g., via laser cutting/drilling). The insert has its own leading and trailing edges 202 and 204 and inboard and outboard ends 206 and 207. Central portions of the inboard and outboard ends 206 and 207 corresponded to and define the slot inboard and outboard ends 195 and 196. The insert has rows 210, 212, 214, 216, 218, 220, 222, 224, and 226 of apertures 230, 232, 234, 236, and 238 corresponding to and define the rows 130-146 of pedestals 160-168. FIG. 5 further shows the insert 200 as having a pair of handling tabs 240 extending from the trailing edge 204. A leading portion 252 is positioned to be inserted into a complementary slot in the ceramic core. For reference, a line 254 is added to designate the trailing boundary of this portion. Similarly, a line 256 shows the location of the trailing edge of the ultimate blade. FIG. 6 shows the blade in an intermediate stage of manufacture. The precursor of the blade is shown being cast in a sacrificial ceramic mold 300 around the assembly of the insert 200 and the ceramic core 302. The leading portion 252 of the insert is embedded in a slot 304 in a trailing portion 306 of the core that forms the aft supply cavity 48. Additional portions 308, 310, 312, 314, 316, and 318 of the core form the legs 60-63, the fore supply cavity 66, and the leading edge impingement cavity 72. Other portions (not shown) form the tip pocket and additional internal features of the blade of FIG. 3. Central portions of pressure and suction side surfaces 208 and 209 of the insert correspond to and define the pressure and suction side surfaces 193 and 194 of the slot and the bounding wall portions 190 and 192. After casting, the mold, core, and insert are destructively removed such as via chemical leaching. Thereafter the blade may be subject to further machining (including drilling of the film holes via laser, electrical discharge, or other means, and finish machining) and/or treatment (e.g., heat treatments, surface treatments, coatings, and the like).

Use of the insert may provide control over pedestal size, geometry, and positioning that might not be obtained economically, reliably and/or otherwise easily with only a single-piece ceramic core. An exemplary strip thickness and associated slot height H is 0.012 inch. In an exemplary dimensioning of the exemplary combination and arrangement of pedestals, the diameter D1 is 0.025 inch and pitch P1 is 0.060 inch leaving a space S1 of 0.035 inch. The ratio of the pedestal dimension along the row (D1) to the pitch defines a percentage of area along the row that is blocked by pedestals. For the identified dimensions this blockage factor is 41.7% for each row in the leading group of rows. The row pitch R1 is 0.060 inch. The diameter D5 is 0.020 inch and the pitch P5 is 0.038 inch having a spacing S5 of 0.018 inch and a blockage factor of 52.6%. The row pitch R5 is 0.031 inch. The exemplary rounded rectangular pedestals have corner radii of 0.005 inch. The length L2 is 0.04 inch, the width W2 is 0.020 inch, and the pitch P2 is 0.063 inch leaving a spacing S2 of 0.023 inch for a blockage factor of 63.5%. The row pitch R2 is 0.055 inch. T he length L3 is 0.025 inch, the width W3 is 0.015 inch, and the pitch P3 is 0.063 inch leaving a spacing S3 of 0.038 inch for a blockage factor of 39.7%. The row pitch R3 is 0.040 inch. The length L4 is 0.025 inch, the width W4 is 0.015 inch, and the pitch P4 is 0.063 inch leaving a spacing S4 of 0.038 inch for a blockage factor of 39.7%. The row pitch R4 is 0.033 inch.

The shapes, dimensions, and arrangement of pedestals may be tailored to achieve desired heat flow properties including heat transfer. A combination of a relatively low blockage arrangement of pedestals over a forward area with relatively higher blockage in metering areas (rows) immediately aft thereof and near the trailing edge may be useful to achieve relatively higher heat transfer near the two metering rows. This concentration may occur with correspondingly less pressure drop than is associated with an impingement cavity, resulting in less thermal/mechanical stress and associated fatigue. The use of elongate pedestals for the first metering row (relative to a greater number of smaller pedestals producing a similar overall blockage factor) controls local flow velocity. The use of a relatively high number of non-elongate pedestals in the trailing metering row serves to minimize trailing wake turbulence. The presence of pedestals between the two metering rows having intermediate elongatedness serves to provide a progressive transition in wakes/turbulence between the two metering rows. The small spacing and high blockage factors associated with the trailing metering row also serves to accelerate the flow for an advantageous match of Mach numbers between the flow exiting the slot outlet and the flows over the pressure and suction sides. This is particularly advantageous where, as in the exemplary embodiment, the true trailing edge is aligned with the slot outlet rather than having an outlet well up the pressure side from the true trailing edge. The advantageous balance may involve a slot trailing edge Mach number of at least 50% of the Mach numbers on pressure and suction sides (e.g., a slot trailing edge Mach number of 0.45-0.55 when the pressure or suction side Mach number is 0.8). The gap 180 aft of the trailing row of pedestals serves to further permit diffusing of the wakes ahead of the slot outlet. This may reduce chances of oxidation associated with combustion gases being trapped in the wakes. For this purpose, the gaps may advantageously be at least the dimension along the row of the trailing pedestals (D5). A broader range is in excess of 1.5 times this dimension and a particular range is 1.5-2.0 times this dimension.

By using a relatively smaller number of relatively larger diameter circular pedestals for the leading group than for the trailing metering row, less heat transfer is incurred over this leading section where it is not as greatly required. The use of relatively large diameter pedestals at a given density provides greater structural integrity.

One or more embodiments of the present invention have been described. Nevertheless, it will be understood that various modifications may be made without departing from the spirit and scope of the invention. For example, details of the turbine element exterior contour and environment may influence cooling needs and any particular implementation of the invention. When applied as a redesign or reengineering of an existing element, features of the existing element may constrain or influence features of the implementation. Accordingly, other embodiments are within the scope of the following claims.

What is claimed is:

1. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, wherein the plurality of posts includes a trailing array of posts having a characteristic transverse dimension and spaced ahead of an outlet of the slot by at least said characteristic transverse dimension.

2. The element of claim 1 wherein the trailing array of posts is spaced ahead of the outlet of the slot at the first and second slot surfaces.

3. The element of claim 1 wherein the trailing array of posts have a characteristic transverse dimension and are spaced ahead of the outlet of the slot by at least said characteristic transverse dimension.

4. The element of claim 3 wherein the trailing array of posts have a circular cross-section.

5. The element of claim 1 wherein the trailing array of posts have a characteristic transverse dimension and are spaced ahead of the outlet of the slot by 1.5-2.0 times said characteristic transverse dimension.

6. The element of claim 1 wherein the trailing array of posts are spaced ahead of the outlet of the slot by at least 0.020 inch.

7. The element of claim 1 wherein the trailing array of posts are spaced ahead of the outlet of the slot by 0.020-0.040 inch.

8. The element of claim 1 being a blade wherein the second end is a free tip.

9. The element of claim 1 wherein the posts have dimensions along the slot no greater than 0.10 inch.

10. The element of claim 1 wherein the plurality of posts includes:

leading group of posts;

a first metering row of posts trailing the leading group and having a greater restriction factor than a restriction factor of the leading group;

said trailing array as a second metering row of posts trailing the first metering row and having a restriction factor greater than the restriction factor of the leading group; and at least one intervening group between the first and second metering rows having a restriction factor less than the restriction factors of the first and second metering rows.

11. The element of claim 1 comprising a nickel alloy casting.

12. The element of claim 1 wherein the plurality of posts includes:

a leading group of a plurality of rows of posts having essentially circular sections;

said trailing array as a trailing row of posts having essentially circular sections; and a plurality of intervening rows of posts having sections elongate the direction of their associated rows.

13. The element of claim 1 wherein the plurality of posts provide a generally progressively rearwardly increasing heat transfer coefficient over a first area, a first peak heat transfer coefficient at a first location aft of said first area, a second peak heat transfer coefficient less than the first peak heat transfer coefficient at a second location aft of the first location, and a local trough in heat transfer coefficient between said first and second locations.

14. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, wherein the plurality of posts includes a trailing array of posts having a characteristic transverse dimension and spaced ahead of an outlet of the slot by at least said characteristic transverse dimension; and wherein the plurality of posts includes:

leading group of posts;

a first metering row of posts trailing the leading group and having a greater restriction factor than a restriction factor of the leading group;

said trailing array as a second metering row of posts trailing the first metering row and having a restriction factor greater than the restriction factor of the leading group; and at least one intervening group between the first and second metering rows having a restriction factor less than the restriction factors of the first and second metering rows.

15. The element of claim 14 comprising a nickel alloy casting.

16. The element of claim 14 wherein the trailing array of posts have a characteristic transverse dimension and are spaced ahead of the outlet of the slot by at least said characteristic transverse dimension.

17. The element of claim 16 wherein the trailing array of posts have a circular cross-section.

18. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, wherein the plurality of posts includes a trailing array of posts having a characteristic transverse dimension and spaced ahead of an outlet of the slot by at least said characteristic transverse dimension; and wherein the plurality of posts includes:

a leading group of a plurality of rows of posts having essentially circular sections;

said trailing array as a trailing row of posts having essentially circular sections; and a plurality of intervening rows of posts having sections elongate the direction of their associated rows.

19. The element of claim 18 wherein the trailing array of posts have a characteristic transverse dimension and are spaced ahead of the outlet of the slot by at least said characteristic transverse dimension.

20. The element of claim 18 wherein the trailing array of posts have a circular cross-section.

21. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, wherein the plurality of posts includes a trailing array of posts having a characteristic transverse dimension and spaced ahead of an outlet of the slot by at least said characteristic transverse dimension; and wherein the plurality of posts provide a generally progressively rearwardly increasing heat transfer coefficient over a first area, a first peak heat transfer coefficient at a first location aft of said first area, a second peak heat transfer coefficient less than the first peak heat transfer coefficient at a second location aft of the first location, and a local trough in heat transfer coefficient between said first and second locations.

22. The element of claim 21 wherein the trailing array of posts have a characteristic transverse dimension and are spaced ahead of the outlet of the slot by at least said characteristic transverse dimension.

23. The element of claim 21 wherein the trailing array of posts have a circular cross-section.

* * * * *